United States Patent [19]

Dreher

[11] 4,242,838

[45] Jan. 6, 1981

[54] CENTRIFUGAL DRUM APPARATUS

[75] Inventor: Manfrid Dreher, Engelsbrand, Fed. Rep. of Germany

[73] Assignee: Dr. Ing. Manfrid Dreher GmbH & Co. K.G., Engelsbrand, Fed. Rep. of Germany

[21] Appl. No.: 957,704

[22] Filed: Nov. 6, 1978

[51] Int. Cl.[3] ..... B24B 31/04

[52] U.S. Cl. ..... 51/164.2

[58] Field of Search ..... 51/7, 73 R, 164.2

[56] References Cited

U.S. PATENT DOCUMENTS

| | | | |
|---|---|---|---|
| 2,387,095 | 10/1945 | Shideler | 51/73 |
| 2,387,138 | 10/1945 | Fruth | 51/73 |
| 3,524,735 | 8/1970 | Oetiker | 51/164.2 |
| 4,104,831 | 8/1978 | Kobayashi | 51/164.2 |

FOREIGN PATENT DOCUMENTS

| | | | |
|---|---|---|---|
| 6929835 | of 1969 | Fed. Rep. of Germany . | |
| 54540 | 1/1911 | Switzerland | 51/164.2 |

*Primary Examiner*—Harold D. Whitehead
*Attorney, Agent, or Firm*—Lawrence E. Laubscher; Lawrence E. Laubscher, Jr.

[57] ABSTRACT

A centrifugal drum apparatus for finishing the surfaces of metal objects is disclosed, including a housing, a disk-shaped rotor member connected with the housing for rotation about a generally horizontal axis, and a plurality of finishing drums open at one end and having longitudinal axes arranged symmetrically about and parallel with the rotor axis, the finishing drums being rotatably connected with the rotor member. The apparatus includes a first drive assembly for rotating the rotor member about the horizontal axis, and a second drive assembly for rotating the finishing drums about their longitudinal axes. When metal objects are placed within the finishing drums and the rotor member and finishing drums are rotated, the surfaces of the metal objects are ground and polished through abrasion with the inner surface of the drums.

3 Claims, 3 Drawing Figures

CENTRIFUGAL DRUM APPARATUS

BRIEF DESCRIPTION OF THE PRIOR ART

Centrifugal drum machines for finishing the surfaces of metallic particles are well known in the prior art as shown for example in the German Design No. 6,929,835. In this prior design, a plurality of finishing drums rotate with a rotor along a circular path about the rotor's axis. Means are also provided to rotate the individual finishing drums about their respective axes. Specifically, an endless double belt drive is provided, the belt being wrapped around a disk on the outer surface of each of the finishing drums and around the outer circumference of a tension roller which is fixed relative to the rotor and is arranged outside of the circular path of rotation of the drums about the rotor axis. As the rotor rotates, the drums travel along the circular path around the rotor axis and the individual drums are rotated about their respective axis.

While the prior centrifugal drum apparatus normally operates quite satisfactorily, it does possess certain inherent drawbacks. For example, all of the finishing drums must be rotated about their respective axes by the same drive means. Furthermore, a large number of finishing drums are required to maintain the requisite amount of tension on the belt to drive the drums. Also, as the finishing drums pass the tension roller, the drums come out of contact with the endless belt resulting in a non-uniform rotation of the drums about their respective axes.

SUMMARY OF THE INVENTION

Accordingly, it is a primary object of the present invention to provide a centrifugal drum apparatus for finishing the surfaces of metal particles including a housing, a rotor, and a plurality of finishing drums connected with the rotor for rotation therewith about a horizontal axis. A first drive means drives the rotor about the horizontal axis and a second drive means is provided to rotate each of the finishing drums about their longitudinal axes which are symmetrical about and extend parallel with the rotor axis. Thus when metal objects are placed within the finishing drums and the rotor is rotated, the surfaces of the metal objects are polished through abrasion with each other and the inner surface of the drums as a result of the centrifugal forces applied thereto.

According to a more specific object of the present invention, the second drive means includes a stationary sprocket wheel means concentrically arranged relative to the rotor axis, rotatable sprocket wheels connected with each of the finishing drums for rotation about their longitudinal axes, and flexible endless chain means connecting the sprocket wheels whereby the individual drums are driven about their longitudinal axes as the rotor is driven about its horizontal axis.

According to a further object of the present invention, the stationary sprocket wheel means includes a plurality of colinearly arranged drive sprocket wheels and the endless chain means includes a plurality of endless chains associated with the drive sprocket wheels, the endless chains being operatively connected with different rotatable sprocket wheels to distribute the driving force applied to the finishing drums.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
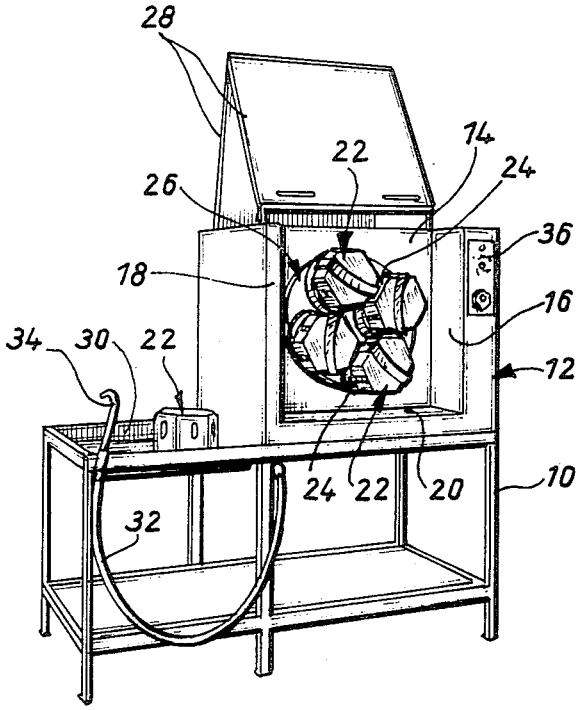
FIG. 1 is a front perspective view of the centrifugal finishing drum apparatus.

Referring first to FIG. 1, the cylindrical finishing drum apparatus includes a base 10 and a housing 12, the housing having a recessed front wall 14, side walls 16,18, and a bottom wall 20. Connected with the housing is a rotor member 26 having a plurality of generally cylindrical finishing drums 22 mounted thereon by means of conventional receiving connector devices 24. The rotor member 26 is generally disk-shaped and is connected with the housing for rotation about a generally horizontal first axis. Similarly, the finishing drums 22 are symmetrically arranged about the first horizontal axis and rotate with the rotor member about the first axis. As will be discussed more fully below, the finishing drums are open at one end for receiving a plurality of metal objects. The inner surfaces of the drums comprise abrasive surfaces for grinding and polishing the metal objects. Each of the finishing drums 22 has a longitudinal axis which extends parallel with the rotor first horizontal axis, and the drums are adapted for rotation about their longitudinal axes.

The housing 12 further includes a locking cover 28 which may be pivoted to cover the finishing drums 22 during operation of the apparatus. The base 10 includes a platform area 30 where the finishing drums may be cleaned and filled. For cleaning purposes, the apparatus may include a water hose 32 having a nozzle 34 for spraying the interiors of the finishing drums. A control panel 36 is located on the front portion of the housing 12.

Figure 2:
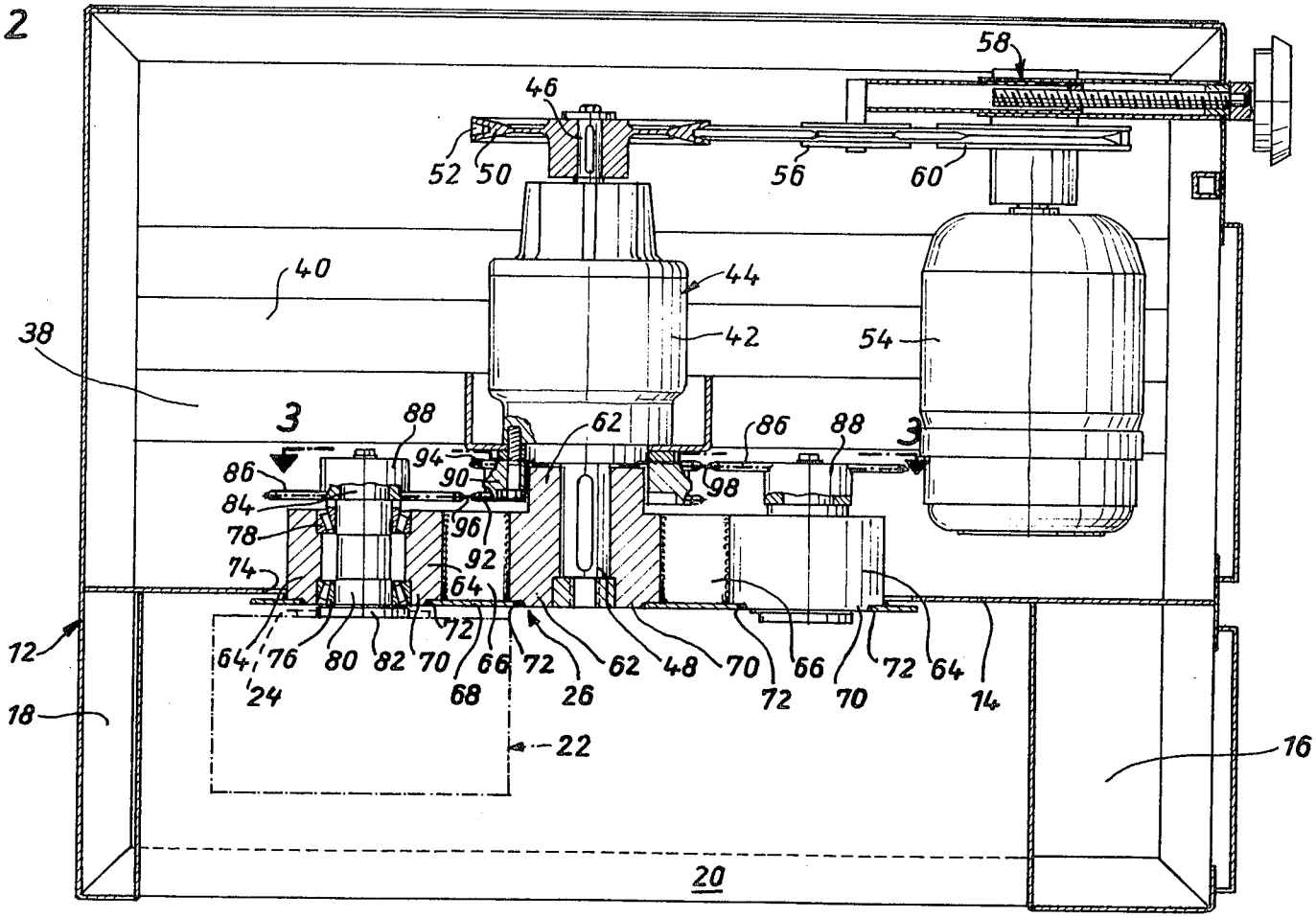
FIG. 2 is a partial sectional top view of the finishing drum apparatus.
Figure 3:
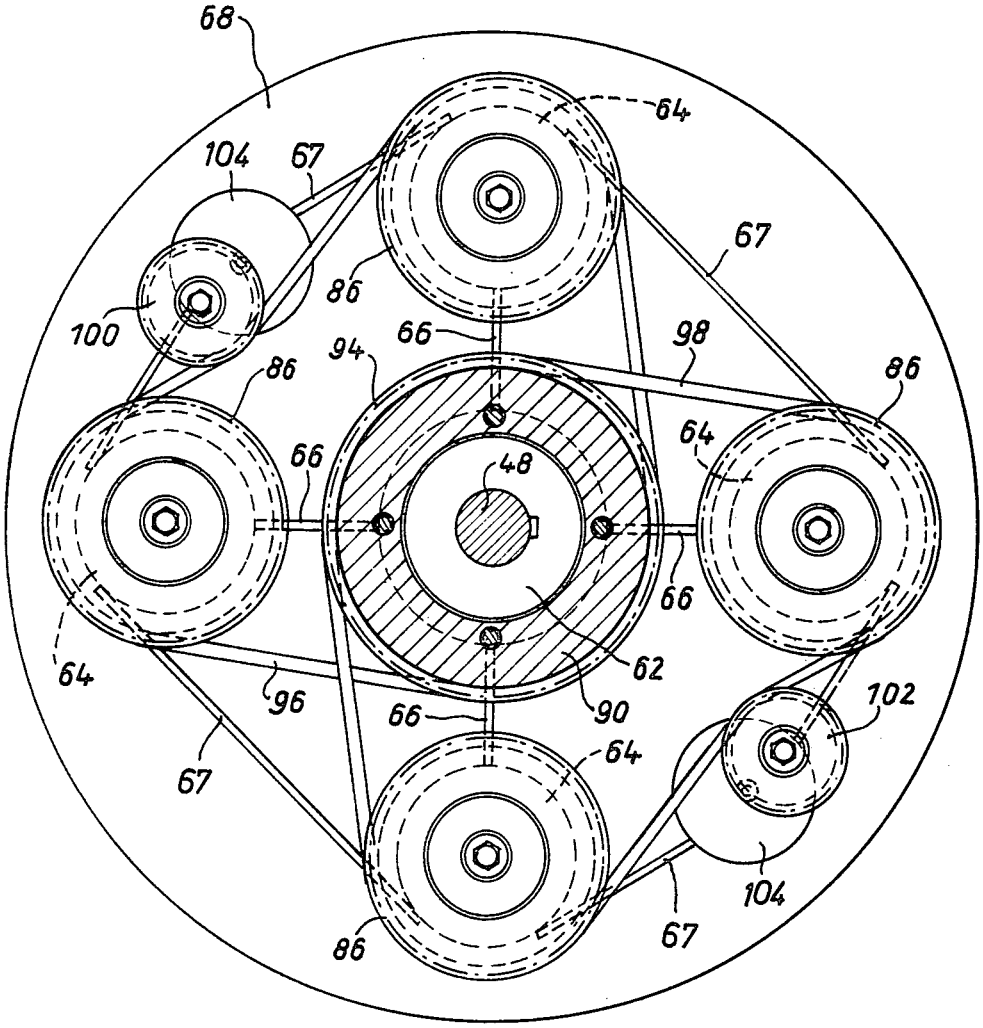
FIG. 3 is a sectional view taken along line 3—3 of FIG. 2.

The structure of the rotor member 26 will be described in greater detail with reference to FIGS. 2 and 3. As shown in FIG. 2, the housing 12 includes a rear compartment 38 located behind the recessed front wall 14. Within the rear compartment 38 there is arranged a lateral crossbar 40. Mounted on the crossbar 40 is the housing 42 of a reduction gear generally indicated as 44. Extending longitudinally through the reduction gear is a drive shaft 46 which drives the rotor member 26 about the first axis. The drive shaft 46 includes on its rear portion a pulley 50 which receives a belt 52 such as a V-belt which cooperate to turn the shaft. The belt 52 is driven by a motor 54 which is also mounted on the crossbar 40. The motor has a pulley 60 for receiving the belt 52 to transmit the drive to the drive shaft pulley 50. An adjusting mechanism 58 for a belt tension roller 56 may be used to vary the speed of rotation of the drive shaft by laterally displacing the tension roller 56 relative to the belt 52 and the pulley 60.

Extending from the reduction gear housing 42 is an off-drive shaft 48 which is used to drive the rotor member 26. The rotor member 26 includes a hub portion 62 and a plurality of bearing housings 64 each of which has connected thereto one of the finishing drums 22. Retaining bars 66 connect each of the bearing housings 64 with the hub portion 62 of the rotor member. Similarly, brace bars 67 connect the adjacent bearing housings with one another as shown in FIG. 3. The retaining bars 66 and the brace bars 67 preferably have a rectangular cross-section and are connected with the bearing housings 64 and the hub portion 62 by welding. The rotor member further includes a disk-shaped bracing plate 68 between the hub portion 62 and the bearing housings 64. The bracing plate 68 has a plurality of openings 72 for receiving a cylindrical portion 70 of each of the bearing housings 64. The recessed front wall 14 contains an opening 74. Extending from the rear housing compartment through the opening 74 are a portion of the bearing housings 64 adapted to receive the finishing drums 22. The disk-shaped bracing plate 68 is arranged adjacent the front portion of the front wall 14 and has a diameter slightly greater than the diameter of the opening 74 as shown in FIG. 2.

Within each of the bearing housings 64 there is arranged a longitudinal bearing shaft 80 adapted for rotation about an axis parallel with the rotor first horizontal axis by means of bearings such as roller bearings 76,78. The bearing shaft 80 has a receiving flange 82 to which is attached the open end of one of the finishing drums 22. At its front portion, the bearing shaft receiving flange 82 extends from the bearing housing 64. The bearing shaft has a rear portion 84 which extends from the rear of the bearing housing 64. Connected with the rear portion of the bearing shaft 80 is a rotatable cylindrical collar 86 such as a sprocket wheel having a central hub portion 88.

A stationary cylindrical collar 90 is connected with the reduction gear housing 42 and is concentrically arranged with respect to the rotor horizontal first axis. The stationary collar preferably comprises a pair of colinear cylindrical sprocket wheels 92,94. A plurality of chains 96,98 connect the stationary sprocket wheels 92,94 with different rotatable sprocket wheels. Thus, as shown in FIG. 3, a first chain 96 connected with the stationary sprocket wheel 92 may be connected with two of the rotatable sprocket wheels and a second chain 98 connected with the sprocket wheel 94 may be connected with the remaining two rotatable sprocket wheels. Chain tension rollers 102 mounted on members 104 are provided to adjust the tension of the chains 96,98.

In operation, a plurality of metal particles are placed in the finishing drums 22 which are attached to the receiving flanges 82 of the bearing shafts 80 by means of receiving connector devices 24. The motor 54 is actuated to turn the rotor assembly about its horizontal first axis by means of the V-belt 52 and pulleys 50,60 which turn the drive shaft 46 and the off-drive shaft 48.

As the rotor assembly rotates about the first axis, the rotatable sprocket wheels 86 are driven by the chains 96,98 off of the stationary sprocket wheels 92,94. Rotation of the rotatable sprocket wheels rotates the bearing shafts 80 to rotate each of the finishing drums 22 about their longitudinal axes. The centrifugal forces applied to the metallic particles within the drums causes the particles to strike one another and the inner surfaces of the drums to grind and polish the surfaces of the particles.

The improved drive system for rotating the finishing drums about their longitudinal axes is characterized by increased versatility and reliability. The chains are in constant contact with the rotatable and fixed sprocket wheels and uniform tension is maintained between the two. Individual finishing drums may be driven by different chains or a single chain may be used to drive a plurality of drums. While the ratio of rpms between the stationary sprocket wheels and the rotatable sprocket wheels remains constant, individual finishing drums may be driven at different speeds by substituting rotatable sprocket wheels of larger or smaller diameters.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. In a centrifugal drum apparatus for finishing the surfaces of metal objects including a housing (12), a generally disk-shaped rotor member (26) connected with said housing for rotation about a generally horizontal first axis, a cylindrical stationary rotor bearing collar member (90) connected with said housing and containing a longitudinal through-opening coaxial with said first axis, a plurality of cylindrical finishing drums (22) each being open at one end and arranged with its longitudinal axis extending parallel with said first axis, said drums being symmetrically arranged about said first axis and being rotatably connected with said rotor member, first drive means for rotating said rotor member about said first axis, and second drive means for rotating said finishing drums about their longitudinal axes, respectively, whereby when the metal objects are introduced into said drums, they are polished during the rotation of said drums about their longitudinal axes, the improvement wherein said rotor member includes:

(a) a plurality of finishing drum bearing means, each of said bearing means including
  (1) a bearing housing (64) adapted to receive the open end of one of said finishing drums;
  (2) a bearing shaft (80) arranged within said bearing housing with its longitudinal axis extending parallel with said first axis, one end of said shaft being connected with said second drive means;
  (3) a receiving flange (82) arranged at the other end of said shaft; and
  (4) a connector device (24) for connecting one of said finishing drums with said bearing receiving flange;
(b) a drive shaft (48) extending longitudinally through said rotor bearing collar member through-opening, said first drive means being connected with one end of said drive shaft, said drive shaft having a hub portion (62) arranged at its other end;
(c) first brace members (66) extending radially from said hub portion and being connected with said finishing drum bearing housings;
(d) second brace members (67) connecting the adjacent bearing housings; and
(e) an annular bracing plate (68) connected with said drive shaft hub portion, said bracing plate including a plurality of openings (72), each of said openings being adapted to receive one of said bearing housings.

2. Apparatus as defined in claim 1, wherein said first and second brace members have a rectangular cross-section.

3. Apparatus as defined in claim 2, wherein said first and second brace members are connected with said bearing housings by welding.

* * * * *